US006162958A

United States Patent [19]

Tateishi et al.

[11] Patent Number: 6,162,958

[45] Date of Patent: Dec. 19, 2000

[54] PCB DECOMPOSITION PROCESS

[75] Inventors: Masakazu Tateishi; Yoshihiko Tsuchiyama; Yasuhiro Yamauchi; Tadatsugu Fukuzumi; Toshiyuki Hatano, all of Nagasaki, Japan

[73] Assignee: Mitsubishi Heavy Industries, Ltd., Tokyo, Japan

[21] Appl. No.: 09/266,664

[22] Filed: Mar. 11, 1999

[30] Foreign Application Priority Data

Mar. 13, 1998 [JP] Japan ..... 10-062638

[51] Int. Cl.[7] ..... A62D 3/00

[52] U.S. Cl. ..... 588/207; 588/205; 588/208; 588/218; 588/226

[58] Field of Search ..... 588/205, 207, 588/208, 218, 226; 210/759, 760, 761

[56] References Cited

U.S. PATENT DOCUMENTS 4,416,767 11/1983 Jordan ..... 208/262.1

5,746,926 5/1998 Ross et al. ..... 210/761

5,837,149 11/1998 Ross et al. ..... 210/759

OTHER PUBLICATIONS

D.S. Ross et al., "Assisted Hydrothermal Oxidation—A Prosposed On–Site Disposal Technology for Halogenated Waste," The Second International Conference on Solvothermal Reactions, Dec. 1996.

Suzuki et al.; Commercialization of Supercritical Water Oxidation. Destruction of Trichloroethylene, Dimethyl Sulfoxide and Isopropyl Alcohol with a Pilot–Scale Process, The 4$^{th}$ International Symposium on Supercritical Fluids, vol. C, p. 895–900, Sendai, Japan, May 11–14, 1997.

*Primary Examiner*—Steven P. Griffin
*Assistant Examiner*—Eileen E. Nave
*Attorney, Agent, or Firm*—Myers Bigel Sibley & Sajovec, P.A.

[57] ABSTRACT

This invention relates to a PCB decomposition process which comprises the steps of reacting an organic material with sodium hydroxide to form sodium carbonate, and decomposing PCB with the aid of the sodium carbonate so formed.

1 Claim, 2 Drawing Sheets

PCB DECOMPOSITION PROCESS

FIELD OF THE INVENTION AND RELATED ART STATEMENT

This invention relates to a process for the hot water decomposition of PCB. More particularly, it relates to an efficient process for the oxidative decomposition of PCB in hot water.

Conventionally, PCB was disposed of solely by incineration. However, this method is very likely to produce harmful materials (e.g., dioxins) as by-products and, therefore, incineration disposal is not employed at present. As a process producing no harmful materials (e.g., dioxins), there has recently been proposed a process wherein PCB is oxidatively decomposed in supercritical water having a temperature of 374° C. or above and containing an oxidizing agent. However, since PCB is chemically stable, it is actual practice to decompose PCB at a very high temperature which usually reaches 600°C. or so.

For example, according to a paper entitled "Commercialization of the Supercritical Water Oxidation Destruction of Trichloroethylene, Dimethyl Sulfoxide and Isopropyl Alcohol by a Pilot-Scale Process", which was presented at the 4th International Symposium on Supercritical Fluids, May 11–14, 1997, Sendai, Japan", trichloroethylene and PCB are oxidized at high temperatures of 600° C. and 650° C., respectively, so that they are decomposed into carbon dioxide, water and hydrochloric acid. Since the hydrochloric acid so produced is very highly corrosive, it is neutralized by the addition of sodium hydroxide and thus converted into sodium chloride.

In this process, when calculated from the data shown in the aforementioned reference, the amount of sodium hydroxide added is somewhat larger than the amount required to neutralize the hydrochloric acid produced from trichloroethylene. Thus, no consideration is given to the amount required to neutralize the carbon dioxide produced from isopropyl alcohol added as a solvent for trichloroethylene. Accordingly, the process of the aforementioned reference has the disadvantage that the equipment is severely corroded by a hot acid solution.

OBJECT AND SUMMARY OF THE INVENTION

In view of the above-described problems, the present inventors made intensive investigations for the purpose of developing a process which can decompose organic chlorine compounds stably and efficiently even in a much lower temperature region than the temperature of 600° C. which has conventionally been employed for the decomposition reaction, while eliminating the problem of corrosion of the reactor.

As a result, the present inventors have now found that these problems can be solved by reacting an organic material 0 with sodium hydroxide to form sodium carbonate, and decomposing PCB with the aid of the sodium carbonate so formed. The present invention has been completed from this point of view.

The present invention provides a PCB decomposition process which comprises the steps of reacting an organic material with sodium hydroxide to form sodium carbonate, and decomposing PCB with the aid of the sodium carbonate so formed. In this process, it is preferable that the carbon dioxide produced during the decomposition of PCB with the aid of sodium carbonate is reacted with sodium hydroxide to form sodium carbonate, and the resulting sodium carbonate is circulated for use in the decomposition of PCB.

More specifically, according to the present invention, a PCB-free oil or organic solvent (i.e., an organic material) is first introduced into a sodium hydroxide solution having a temperature of 350° C. or above and oxidatively decomposed in the presence of oxygen, and the resulting carbon dioxide is reacted with sodium hydroxide. In this step, it is necessary to control the amount of sodium hydroxide added so that the pH of the solution will be maintained at a value of not less than 7.5 at ordinary temperature and part of the added sodium hydroxide will surely be converted into sodium carbonate.

Then, as soon as the temperature has reached a predetermined value of 350° C. or above, the disposal of PCB is started by introducing PCB or a PCB-containing fluid in place of the oil or organic solvent (i.e., the organic material). If no sodium hydroxide is added in this step, the sodium carbonate is consumed to cause a reduction in reaction rate.

Accordingly, also in the course of this PCB disposal, the amount of sodium hydroxide added is controlled so that the pH of the solution within the reactor will be maintained at a value of not less than 7.5. Thus, if the conditions under which solid particles of sodium carbonate surely exist in the solution are maintained so as to regenerate the consumed sodium carbonate, PCB can be continuously decomposed without reducing the reaction rate.

According to the process of the present invention, PCB can be very efficiently decomposed by carrying out its oxidative decomposition reaction in hot water which constitutes an alkaline solution having a temperature of 350° C. or above. That is, this process permits PCB to be very efficiently decomposed in hot water even in a much lower temperature region than 600° C. Moreover, the problem of scaling with sodium carbonate ($Na_2CO_3$) can be eliminated because no sodium carbonate is added. Furthermore, since the reactions are carried out in an alkaline pH range, troubles due to corrosion of the reactor can be avoided.

DETAILED DESCRIPTION OF PREFERRED EMBODIMENTS

One embodiment of the present invention is described below with reference to the accompanying drawings and Table 1 which will be given later.

Figure 1:
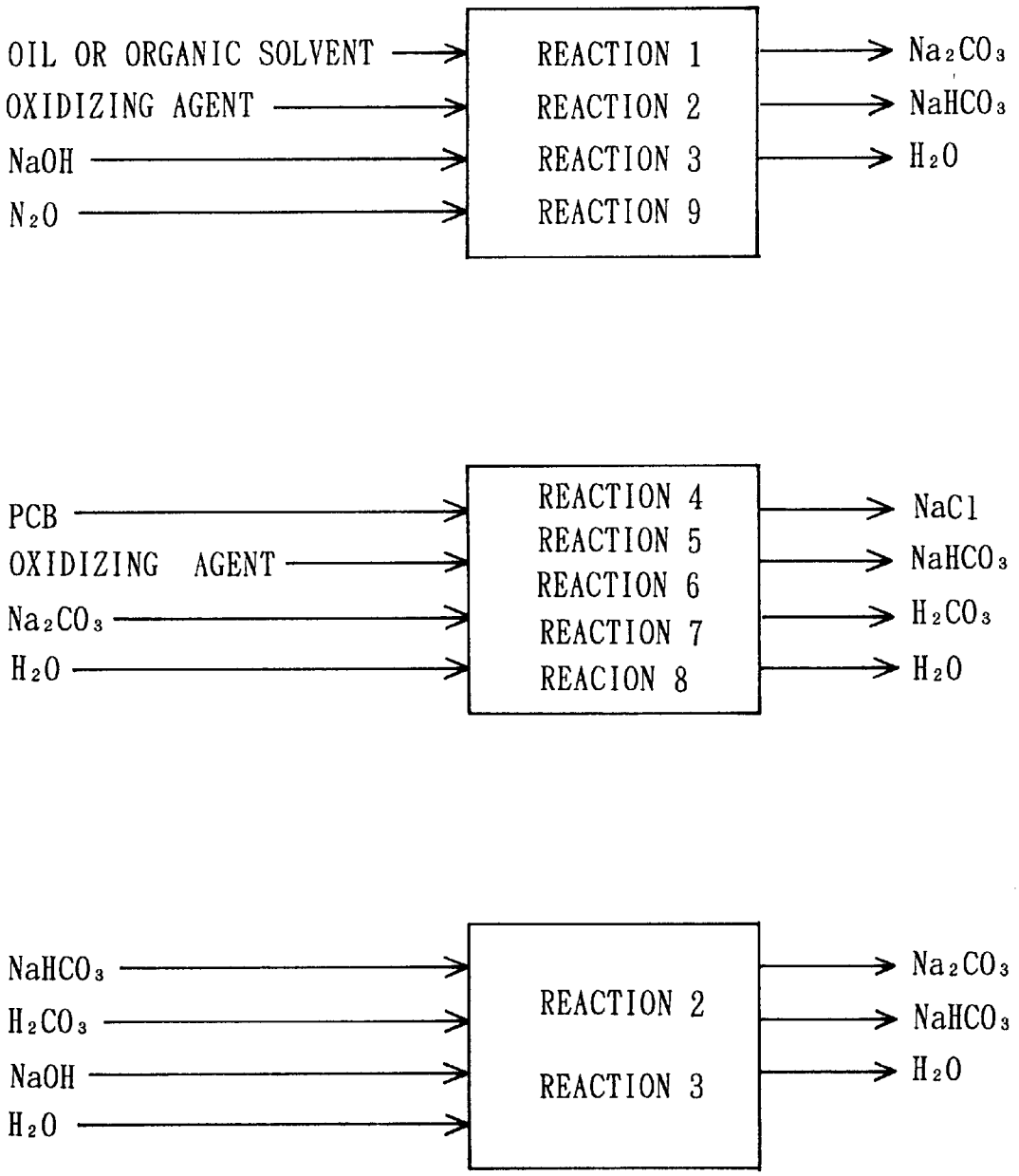
FIG. 1 is a schematic diagram for explaining three reaction stages of the present invention.

FIG. 1 is a schematic diagram showing three reaction stages of the present invention.

The first stage shown in FIG. 1 is a stage for controlling the PCB decomposition conditions and includes the oxidation of an oil or an organic solvent (reaction 9), the formation of sodium bicarbonate (reaction 2), and the formation of sodium carbonate (reaction 3). In this stage, sodium bicarbonate ($NaHCO_3$) and sodium carbonate ($Na_2CO_3$) are formed in a reactor, so that the sodium carbonate exists in the form of fine particles having high surface activity.

The second stage shown in FIG. 1 is a stage for decomposing PCB oxidatively in the presence of the fine particles of sodium carbonate which have been formed in the first stage. In this stage, the chlorine present in PCB reacts with sodium to form sodium chloride (NaCl) (reaction 4), and sodium carbonate is converted into sodium bicarbonate by reaction with the carbon dioxide ($CO_2$) resulting from the oxidation of PCB (reaction 5), and the excess carbon dioxide is converted into carbonic acid ($H_2CO_3$) (reaction 6). The oxidizing agent used in the first and second stages may comprise, for example, oxygen, air or hydrogen peroxide.

The third stage shown in FIG. 1 is a stage for neutralizing the carbonic acid produced in the second stage with sodium hydroxide (HaOH) to form sodium bicarbonate (reaction 2) and for regenerating the consumed sodium carbonate (reaction 3).

The reaction formulae representing the various reactions taking place in the three stages of the present invention are shown in Table 1 below.

TABLE 1

| | |
|---|---|
| Reaction formula 1 | $CO_2 + H_2O$ <-> $H_2CO_3$ (Reversible reaction for the formation of an aqueous solution of carbonic acid) |
| Reaction formula 2 | $H_2CO_3 + NaOH$ <-> $NaHCO_3 + H_2O$ (Reversible reaction between carbonic acid and sodium bicarbonate) |
| Reaction formula 3 | $NaHCO_3 + NaOH$ <-> $Na_2CO_3 + H_2O$ (Reversible reaction between sodium bicarbonate and sodium carbonate) |
| Reaction formula 4 | $C_{12}H_6Cl_4 + 12.5O_2 + 2Na_2CO_3$ -> $4NaCl + 3H_2O + 14CO_2$ (Oxidative decomposition reaction of PCB) |
| Reaction formula 5 | $Na_2CO_3 + H_2O + CO_2$ <-> $2NaHCO_3$ (Reaction of sodium carbonate with carbon dioxide) |
| Reaction formula 6 | $NaHCO_3 + H_2O + CO_2$ <-> $NaHCO_3 + H_2CO_3$ (Dissolution of carbon dioxide in a sodium bicarbonate solution) |
| Reaction formula 7 | $C_{12}H_6Cl_4 + 12.5O_2 + 16Na_2CO_3 + 14H_2O$ -> $4NaCl + 3H_2O + 28NaHCO_3$ (Reaction for decomposing PCB into NaCl, water and sodium bicarbonate) |
| Reaction formula 8 | $C_6H_5CH_3 + 9O_2 + 7Na_2CO_3 + 7H_2O$ -> $4H_2O + 14NaHCO_3$ (Reaction for converting toluene into water and sodium bicarbonate by reaction with sodium carbonate and oxygen) |
| Reaction formula 9 | $C_6H_5CH_3 + 9O_2$ -> $4H_2O + 7CO_2$ |

The aforesaid reaction formulae 1–9 are more fully explained hereinbelow.

Reaction formula 1 represents a reversible reaction in which carbon dioxide dissolves in water to form an aqueous solution of carbonic acid. Reaction formula 2 represents a reversible reaction in which 1 mole of carbonic acid reacts with 1 mole of sodium hydroxide to form sodium bicarbonate. Reaction formula 3 represents a reversible reaction in which 1 mole of sodium bicarbonate reacts with 1 mole of sodium hydroxide to form sodium carbonate.

Reaction formula 4 represents an exemplary reaction in which PCB is oxidatively decomposed in hot water containing fine solid particles of sodium carbonate. Although the case in which the PCB has 4 chlorine (Cl) atoms attached thereto is shown here as a specific example, the decomposition process of the present invention is applicable to all PCBs which may have up to 10 chlorine atoms. Reaction formula 5 represents a reversible reaction in which sodium carbonate reacts with carbon dioxide to form sodium bicarbonate. Reaction formula 6 represents a reversible reaction in which carbon dioxide dissolves in a sodium bicarbonate solution, so that sodium bicarbonate and carbonic acid coexist.

Reaction formula 7 represents an exemplary reaction in which PCB is decomposed into sodium chloride, water and sodium bicarbonate in hot water containing fine solid particles of sodium carbonate. Here, a reaction for a PCB having 4 chlorine (Cl) atoms attached thereto is shown as a specific example. Reaction formula 8 represents an exemplary reaction in which an oil or an organic solvent is decomposed into water and sodium bicarbonate in hot water containing fine solid particles of sodium carbonate. Although the case in which the organic solvent comprises toluene is shown here as a specific example, any of commonly used organic solvents including aromatic compounds such as toluene and xylene may be used. Reaction formula 9 represents an exemplary reaction in which an oil or an organic solvent is oxidatively decomposed into carbon dioxide and water. Again, the case in which the organic solvent comprises toluene is shown here as a specific example.

Figure 2:
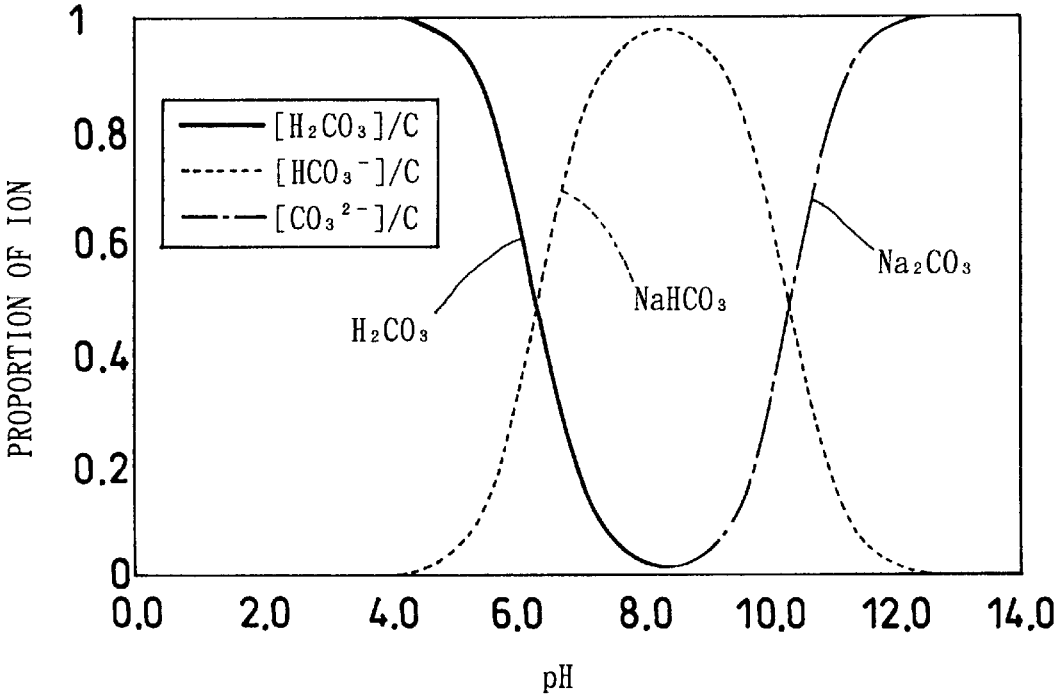
FIG. 2 is a diagram showing the relationship between the pH of the solution and the proportion of sodium carbonate.

As shown in the above reaction formula 9, when an oil or an organic solvent is oxidized in hot water, carbon dioxide and water are formed. The carbon dioxide dissolves in hot water to form an aqueous solution of carbonic acid as shown In reaction formula 1. When 1 mole of sodium hydroxide Is added to 1 mole of the carbonic acid, 1 mole of sodium bicarbonate is formed as shown in reaction formula 2. When 1 mole of sodium hydroxide is further added to 1 mole of the sodium bicarbonate, 1 mole of sodium carbonate is formed as shown in reaction formula 3. Reaction formulae 1, 2 and 3 represent reversible reactions, and the proportions of the respective compounds existing, for example, at ordinary temperature vary with the pH of the solution as shown in FIG. 2.

Figure 3:
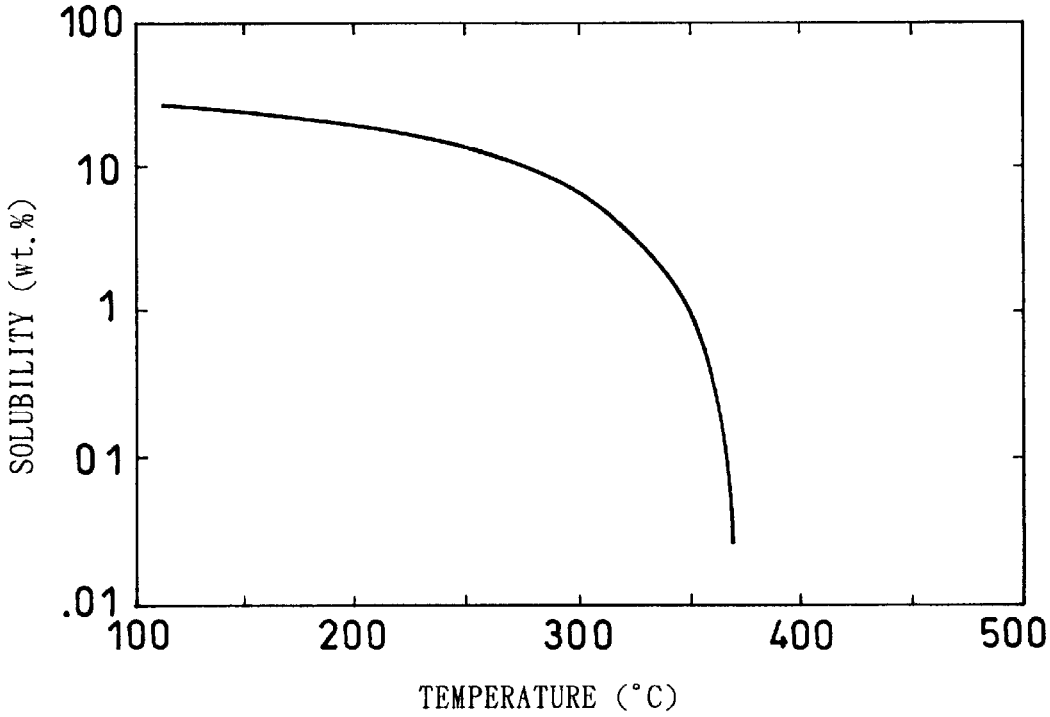
FIG. 3 is a graphical representation of a solubility curve showing the solubility of sodium carbonate at various temperatures.

On the other hand, as shown in FIG. 3, sodium carbonate has a solubility approaching 30% at temperatures of 300° C. or below. However, its solubility decreases rapidly when the temperature exceeds 300° C. Especially at a temperature of 350° C. or above, sodium carbonate tends to precipitate in the form of fine solid particles. Such fine solid particles of sodium carbonate have very high surface activity and serve to accelerate the dechlorination reaction of PCB and the oxidation reaction of an organic material as shown by reaction formulae 4, 7 and 8.

Accordingly, when PCB or a PCB-containing oil, together with an oxidizing agent (e.g., oxygen, air or hydrogen peroxide), is injected into hot water having a temperature of at least 350° C. and containing fine solid particles of sodium carbonate, the PCB is completely decomposed into NaCl, water and carbon dioxide according to reaction formula 4. Moreover, similarly to the PCB, the oil is also oxidatively decomposed according to reaction formula 8, resulting in the formation of water and sodium bicarbonate.

In this process, as can be seen from reaction formula 4, some sodium carbonate is consumed by reacting with the PCB to form NaCl. Moreover, as shown by reaction formula 5, some sodium carbonate is converted into sodium bicarbonate by reaction with the resulting carbon dioxide. Furthermore, as shown by reaction formula 6, the carbon dioxide existing in excess is used to form an aqueous solution of sodium bicarbonate and carbonic acid. Thus, the sodium carbonate particles were exhausted and, therefore, the PCB decomposition reaction is retarded to an extreme degree.

For this reason, in order to continue the PCB decomposition reaction, it is necessary to add an appropriate amount of sodium hydroxide, react it with the resulting carbon dioxide, and thereby make up for the consumed sodium carbonate. The amount of sodium carbonate added in this manner should be at least equal to the sum of the amount required to convert the chlorine (Cl) present in the PCB into NaCl and the amount required to convert the resulting carbon dioxide into sodium bicarbonate. Specifically, since the simultaneous or successive reactions represented by reaction formulae 4, 5 and 6 are collectively shown by the overall reaction of reaction formula 7, 16 moles of sodium carbonate is consumed in order to decompose 1 mole of a PCB having 4 chlorine (Cl) atoms attached thereto.

Moreover, with respect to the reactions involving an oil or an organic solvent (i.e., an organic material), the simultaneous or successive reactions represented by reaction formulae 9, 5 and 6 are collectively shown by the overall reaction of reaction formula 8. Consequently, in the case, for example, of toluene, the amount of sodium carbonate consumed in this reaction is 7 moles for each mole of toluene.

As explained above, when 1 mole of a PCB having 4 Cl atoms is oxidatively decomposed in hot water containing fine solid particles of sodium carbonate, 16 moles of sodium carbonate is consumed and converted into sodium bicarbonate. Accordingly, if at least 16 moles of sodium hydroxide is added, sodium carbonate is regenerated as shown by reaction formula 3. Moreover, for the oil other than PCB, sodium hydroxide should be added in an amount equimolar to the carbon dioxide resulting from the oxidative decomposition of the oil, so that sodium carbonate is regenerated as shown by reaction formula 3. Thus, the decomposition reaction of the PCB or PCB-containing oil in hot water is continued.

In this process, since sodium carbonate needs to exist in the solution, its pH at ordinary temperature must be maintained at a value of not less than 7.5 as shown in FIG. 2.

Accordingly, in order to carry out the oxidative decomposition of PCB or a PCB-containing oil in hot water having a temperature of 350° C. or above, the process may be operated in the following manner.

At the start of the operation, as shown in the first stage of FIG. 1, a PCB-free oil or organic solvent (i.e., an organic material) is first introduced into a reactor containing a sodium hydroxide solution having a temperature of 350° C. or above and oxidatively decomposed in the presence of oxygen, and the resulting carbon dioxide is reacted with sodium hydroxide. In this step, it is necessary to control the amount of sodium hydroxide added so that the pH of the solution within the reactor will be maintained at a value of not less than 7.5 at ordinary temperature and part of the added sodium hydroxide will surely be converted into sodium carbonate. Thus, if the temperature is raised to 350° C. or above, sodium carbonate precipitates in the form of fine crystals having high surface activity.

As soon as the temperature of the reactor has reached a predetermined value of 350° C. or above, the disposal of PCB is started by introducing PCB or a PCB-containing fluid in place of the oil or organic solvent. If no sodium hydroxide is added in this step, the sodium carbonate which precipitated in the first stage is consumed and converted into sodium chloride, sodium bicarbonate and carbonic acid, as shown in the second stage of FIG. 1. Consequently, the reaction rate is reduced.

Accordingly, also in the course of this PCB disposal, the amount of sodium hydroxide added is controlled so that the pH of the solution within the reactor will be maintained at a value of not less than 7.5, as shown in the third stage of FIG. 1. Thus, if the conditions under which solid particles of sodium carbonate surely exist in the solution are maintained so as to regenerate the consumed sodium carbonate, PCB can be continuously decomposed without reducing the reaction rate. Accordingly, the reactions shown in the second and third stages of FIG. 1 proceed concurrently in the reactor.

As explained above, by carrying out the oxidative decomposition of PCB in hot water having a temperature of 350° C. or above while adding sodium hydroxide simultaneously so that the pH of the solution within the reactor will be maintained at a value of not less than 7.5 at ordinary temperature, harmful PCB can be rapidly and completely decomposed into NaCl, water and carbon dioxide without producing harmful by-products such as dioxins.

The reaction temperature may have any desired value, so long as it is not less than 350° C. However, since unduly high temperatures cause a reduction in energy efficiency, it is usually advisable to operate the process at a temperature in the range of 350 to 400° C. and preferably 370 to 400° C. Moreover, the pH of the solution within the reactor has only to exceed 7.5. However, as the pH is elevated, sodium hydroxide is used in larger amounts and sodium carbonate is precipitated in excess. Consequently, it is usually advisable to operate the process at a pH in the range of 7.5 to 13 and preferably 8 to 12.

According to the decomposition process of the present invention, the problem of scaling with sodium carbonate ($Na_2CO_3$) can be eliminated because no sodium carbonate (solid) is added. Moreover, since the reactions are carried out in an alkaline pH range, troubles due to corrosion of the reactor can be avoided.

The decomposition process of the present invention permits PCB to be decomposed in hot water in a much lower temperature region than the temperature of 600° C. which has been employed in conventional processes. Moreover, PCB can be decomposed in an alkaline pH range without causing the problem of corrosion of the reactor by hydrochloric acid or the like. Accordingly, the present invention makes it possible to decompose PCB stably while avoiding the problem of corrosion of the reactor by a hot acid solution.

Moreover, according to the decomposition process of the present invention, the problem of scaling with sodium carbonate can be eliminated because no sodium carbonate (solid) is added, and organic chlorine compounds can hence be decomposed efficiently.

Furthermore, the decomposition process of the present invention does not produce harmful chemical substances (e.g., dioxins) as by-products and can hence dispose of PCB with environmental safety. Accordingly, the decomposition process of the present invention has very great significance from an industrial point of view.

WORKING EXAMPLES

The present invention is more specifically explained with reference to the following examples. However, these examples are not to be construed to limit the scope of the invention.

Example 1 and Comparative Example 1

PCB decomposition tests were carried out by using a pressure vessel having an internal volume of 1.5 liters.

These tests were carried out batchwise to make a comparison between the case in which sodium carbonate alone was initially added (Example 1) and the case in which sodium hydroxide was also used to make pH adjustments (Comparative Example 1). The decomposition time was 5 minutes in both cases.

Since it took about 2 hours to heat the solution to a predetermined temperature, PCB was injected with a high-pressure pump after the predetermined temperature was reached. After 5 minutes, a portion of the solution within the vessel was sampled and analyzed for residual PCB by gas chromatography (GC-EC).

The test conditions and test results are shown in Table 2 below.

TABLE 2-1

Results of PCB Decomposition Tests

| | Temperature (° C.) | Pressure ($kg/cm^2$) | PCB charged (g) | $Na_2CO_3$ (g) | NaOH (g) | Oxidizing agent[1)] (g) |
|---|---|---|---|---|---|---|
| Example 1 | 380 | 245 | 2.0 | 12 | 5 | 100 |
| Comparative Example 1 | 380 | 245 | 2.0 | 12 | 0 | 100 |

Note: 1) A 30% aqueous solution of hydrogen peroxide was used.

TABLE 2-2

| | Water (g) | pH of treating solution | Residual PCB (mg) |
|---|---|---|---|
| Example 1 | 500 | 10.1 | <0.0003 |
| Comparative Example 1 | 500 | 6.8 | 4.5 |

As shown in Table 2 above, when sodium carbonate ($Na_2CO_3$) alone was used in the hot water decomposition of PCB (Comparative Example 1), the pH of the treating solution was reduced to 6.8 after 5 minutes' treatment. While 2 g of PCB was initially charged, 4.5 mg of PCB remained undecomposed, so that the degree of decomposition was 99.8%.

It is believed that, in this Comparative Example 1, the decomposition reaction was retarded because the initially charged sodium carbonate was converted into sodium bicarbonate by reaction with the carbon dioxide resulting from the oxidative decomposition of PCB.

On the other hand, sodium hydroxide was used together with sodium carbonate in the test of Example 1. Thus, even if the initially charged sodium carbonate was converted into sodium bicarbonate by reaction with the carbon dioxide resulting from the oxidation of PCB, part of the sodium bicarbonate returned to sodium carbonate in the presence of sodium hydroxide. This accelerated the decomposition reaction, so that a degree of decomposition of greater than 99.9999% was achieved after 5 minutes' reaction.

What is claimed is:

1. A PCB oxidative decomposition process which comprises the steps of reacting an organic material with sodium hydroxide to form sodium carbonate, and decomposing PCB with the aid of the sodium carbonate so formed, wherein carbon dioxide is formed during the decomposition of PCB and wherein the carbon dioxide is reacted with sodium hydroxide to form sodium carbonate, and the resulting sodium carbonate is circulated to aid in the decomposition of PCB, wherein sodium hydroxide is added in an amount so as to maintain a pH of a solution containing the sodium hydroxide at a value of not less than 7.5, wherein the solution containing the sodium hydroxide has a temperature of 350° C. or above.

* * * * *